US007250458B2

(12) United States Patent
Scherer et al.

(10) Patent No.: US 7,250,458 B2
(45) Date of Patent: Jul. 31, 2007

(54) STABLE POLYMER DISPERSIONS AND METHOD FOR THE PRODUCTION THEREOF

(75) Inventors: Markus Scherer, Lebach (DE); Wolfang Tschepat, Darmstadt (DE)

(73) Assignee: RohMax Additives GmbH, Darmstadt (DE)

( * ) Notice: Subject to any disclaimer, the term of this patent is extended or adjusted under 35 U.S.C. 154(b) by 0 days.

(21) Appl. No.: 10/525,942

(22) PCT Filed: Aug. 27, 2003

(86) PCT No.: PCT/EP03/09465

§ 371 (c)(1),
(2), (4) Date: Feb. 28, 2005

(87) PCT Pub. No.: WO2004/037956

PCT Pub. Date: May 6, 2004

(65) Prior Publication Data

US 2005/0239937 A1 Oct. 27, 2005

(30) Foreign Application Priority Data

Oct. 22, 2002 (DE) ..... 102 49 294

(51) Int. Cl.
*C08K 5/10* (2006.01)
*C08K 5/06* (2006.01)

(52) U.S. Cl. ..... 524/315; 524/366; 524/376

(58) Field of Classification Search ..... 524/315, 524/366, 376
See application file for complete search history.

(56) References Cited

U.S. PATENT DOCUMENTS 4,839,068 A * 6/1989 Lange ..... 508/223
5,026,496 A * 6/1991 Takigawa et al. ..... 508/472
5,130,359 A 7/1992 Yoshida et al.
2005/0148749 A1 7/2005 Scherer et al.
2005/0245406 A1 11/2005 Scherer et al.
2005/0261143 A1 11/2005 Scherer et al.
2005/0267239 A1 12/2005 Scherer
2006/0189490 A1 8/2006 Dardin et al.

FOREIGN PATENT DOCUMENTS

DE 32 07 291 9/1983
EP 0 370 669 5/1990
EP 0 819 755 1/1998

OTHER PUBLICATIONS

U.S. Appl. No. 10/593,082, filed Sep. 15, 2006, Scherer, et al.
U.S. Appl. No. 10/592,363, filed Sep. 11, 2006, Scherer, et al.
U.S. Appl. No. 11/587,988, filed Oct. 30, 2006, Fischer, et al.
U.S. Appl. No. 11/547,612, filed Oct. 4, 2006, Scherer, et al.
U.S. Appl. No. 11/572,181, filed Jan. 16, 2007, Scherer, et al.
U.S. Appl. No. 11/572,330, filed Jan. 19, 2007, Acker, et al.

* cited by examiner

*Primary Examiner*—Kriellion Sanders
(74) *Attorney, Agent, or Firm*—Oblon, Spivak, McClelland, Maier & Neustadt, P.C.

(57) ABSTRACT

The present invention relates to a stable polymer dispersion comprising
A) at least one dispersed polyolefin,
B) at least one dispersing component,
C) at least one ester and
D) at least one ether comprising (oligo)oxyalkyl groups, the weight ratio of ester C) to ether D) being in the range from 30:1 to 1:30.

21 Claims, No Drawings

STABLE POLYMER DISPERSIONS AND METHOD FOR THE PRODUCTION THEREOF

The present invention relates to polymer dispersions having high stability, processes for the preparation and the use of these polymer dispersions.

Viscosity index improvers for motor oils are generally substantially hydrocarbon-based polymers. Typical addition levels in motor oils are about 0.5-6% by weight, depending on the thickening effect of the polymers. Particularly economical viscosity index improvers are olefin copolymers (OCP) which are predominantly composed of ethylene- and propylene, or hydrogenated copolymers (HSD) of dienes and styrene.

The excellent thickening effect of these polymer types must be viewed in the light of tedious processibility in the preparation of lubricating oil formulations. In particular, the poor solubility in the oils on which the formulations are based presents difficulties. Where solid polymers which have not been dissolved beforehand are used, there are therefore long periods of stirring in, the use of special stirrers and/or premilling units being necessary.

If concentrated polymers already predissolved in oil are used as customary commercial forms, only a 10-15% strength delivery form of the OCPs or HSDs can be realized. Higher concentrations are associated with excessively high actual viscosities of the solutions (>15 000 $mm^2/s$ at room temperature) and therefore can scarcely be handled. Particularly against this background, highly concentrated dispersions of olefin copolymers and hydrogenated diene/styrene copolymers were developed.

The dispersion technology described permits the preparation of polymer solutions having an OCP or HSD content of more than 20%, kinematic viscosities which permit convenient incorporation into lubricating oil formulations being obtained. In principle, the synthesis of such systems comprises the use of a so-called emulsifier or of a dispersing component. Customary dispersing components are, inter alia, OCP or HSD polymers onto which alkyl methacrylates or alkyl methacrylate/styrene mixtures have generally been grafted. Dispersions in which a solvent which dissolves the methacrylate component of the dispersion better and the OCP or HSD fraction more poorly is used are also known. Such a solvent together with the methacrylate fraction of the product forms the main component of the continuous phase of the dispersion. Formally, the OCP or HSD fraction is the main component of the discontinuous or disperse phase.

Inter alia, the following documents are regarded as prior art:

U.S. Pat. No. 4,149,984
EP-A-0 008 327
DE 32 07 291
DE 32 07 292

U.S. Pat. No. 4,149,984 describes a process for the preparation of lubricating oil additives by improving the compatibility between polyalkyl methacrylates, referred to below as PAMA, and polyolefins. The amount by weight of the PAMA is 50-80% by weight and that of the polyolefin is 20-50%. The total polymer content of the dispersion is 20-55%. The use of dispersing monomers, such as N-vinylpyrrolidone, for grafting is also mentioned. Before this application, it was known that methacrylates can be polymerized onto a polyolefin by grafting (DT-AS 1 235 491).

EP-A-0 008 327 protects the process for the preparation of lubricating oil additives based on a hydrogenated block copolymer of conjugated dienes and styrene, styrene and alkyl methacrylates or exclusively alkyl methacrylates being grafted onto the hydrogenated block copolymer in the first stage and an additional graft (e.g. N-vinylpyrrolidone) is built up in the second stage. The amount of the hydrogenated block copolymer, based on the total polymer content, is 5-55% by weight, that of the first graft consisting of PAMA/styrene is 49.5-85% and that of the second graft is 0.5-10%.

The document DE 32 07 291 describes processes which permit increased incorporation of olefin copolymer. The olefin copolymer content is said to be 20-65% in relation to the total weight of the dispersion. The subject of the invention is that more highly concentrated dispersions are obtained by using suitable solvents which dissolve olefin copolymers poorly and PAMA-containing components well. DE 32 07 291 is to be understood as being a process patent which describes in particular the preparation of the dispersions.

DE 32 07 292 substantially corresponds to DE 32 07 291 but should rather be understood as protecting certain copolymer compositions. These compositions are prepared by a process analogous to that described in DE 32 07 291.

The polymer dispersions described in the prior art already have a good property profile. However, particularly their stability is worthy of improvement. It should be considered here that polymer dispersions have to be stored over long periods without cooling apparatuses generally being used. The storage time includes in particular the transport, etc., temperatures above 40° C. or even 50° C. occurring.

In addition, it was an object of the present invention to provide polymer dispersions having a low viscosity in combination with a high polyolefin content. The higher the content of OCP or HSD, the higher in general is the viscosity of the dispersion. On the other hand, a high content of these polymers is desirable in order to reduce the transport costs. It should be considered here that a lower viscosity permits easier and faster mixing of the viscosity index improvers into the base oil. It was therefore intended to provide polymer dispersions which have a particularly low viscosity.

In addition, the processes for the preparation of the abovementioned polymer dispersions are relatively difficult to control, so that certain specifications can be complied with only with very great difficulty. Accordingly, it was intended to provide polymer dispersions whose viscosity can be easily adjusted to predetermined values.

A further object was to provide polymer dispersions which have a high content of polyolefins, in particular of olefin copolymers and/or of hydrogenated block copolymers.

Furthermore, the polymer dispersions should be capable of being prepared easily and economically, it being intended in particular to use commercially available components. The production should be capable of being carried out on an industrial scale without new plants or plants of complicated design being required for this purpose.

These and further objects which are not explicitly mentioned but which can be readily derived are concluded from the relationships discussed herein at the outset are achieved by polymer dispersions having all the features of Patent claim 1. Expedient modifications of the polymer dispersions according to the invention are protected in the subclaims relating back to claim 1.

Regarding the process for the preparation of polymer dispersions, claim 17 provides an achievement of the underlying object, while claim 18 protects a preferred use of a polymer dispersions of the present invention.

Because polymer dispersions comprise

A) at least one dispersed polyolefin,

B) at least one dispersing component,

C) at least one ester and

D) at least one ether comprising (oligo)oxyalkyl groups, the weight ratio of ester C) to ether D) being in the range from 30:1 to 1:30, it is possible to provide, in a manner not directly foreseeable, polymer dispersions which have particularly high stability.

At the same time, a number of further advantages can be achieved by the polymer dispersions according to the invention. These include inter alia:

The polymer dispersions according to the invention may comprise particularly large amounts of polyolefins which have a viscosity index-improving or, in lubricating oils, a thickening effect.

The polymer dispersions of the present invention can be adjusted in a particularly simple manner to a predetermined viscosity.

Polymer dispersions according to the subject of the present invention have a low viscosity.

The preparation of the polymer dispersions of the present invention can be carried out in a particularly easy and simple manner. Customary, industrial plants can be used for this purpose.

The Component A)

The polymer dispersion comprises, as a component essential to the invention, polyolefins which preferably have a viscosity index-improving or thickening effect. Such polyolefins have long been known and are described in the documents mentioned in the prior art.

These polyolefins include in particular polyolefin copolymers (OCP) and hydrogenated styrene/diene copolymers (HSD).

The polyolefin copolymers (OCP) to be used according to the invention are known per se. They are primarily polymers synthesized from ethylene, propylene, isoprene, butylene and/or further α-olefins having 5 to 20 C atoms, as are already recommended as VI improvers. Systems which have been grafted with small amounts of oxygen- or nitrogen-containing monomers (e.g. from 0.05 to 5% by weight of maleic anhydride) may also be used. The copolymers which contain diene components are generally hydrogenated in order to reduce the oxidation sensitivity and the crosslinking tendency of the viscosity index improvers.

The molecular weight Mw is in general from 10 000 to 300 000, preferably between 50 000 and 150 000. Such olefin copolymers are described, for example, in the German Laid-Open Applications DE-A 16 44 941, DE-A 17 69 834, DE-A 19 39 037, DE-A 19 63 039 and DE-A 20 59 981.

Ethylene/propylene copolymers are particularly useful and terpolymers having the known ternary components, such as ethylidene-norbornene (cf. Macromolecular Reviews, Vol. 10 (1975)) are also possible, but their tendency to crosslink must also be taken into account in the aging process. The distribution may be substantially random, but sequential polymers comprising ethylene blocks can also advantageously be used. The ratio of the monomers ethylene/propylene is variable within certain limits, which can be set to about 75% for ethylene and about 80% for propylene as an upper limit. Owing to its reduced tendency to dissolve in oil, polypropylene is less suitable than ethylene/propylene copolymers. In addition to polymers having a predominantly atactic propylene incorporation, those having a more pronounced isotactic or syndiotactic propylene incorporation may also be used.

Such products are commercially available, for example under the trade names Dutral® CO 034, Dutral® CO 038, Dutral® CO 043, Dutral® CO 058, Buna® EPG 2050 or Buna® EPG 5050.

The hydrogenated styrene/diene copolymers (HSD) are likewise known, these polymers being described, for example, in DE 21 56 122. They are in general hydrogenated isoprene/styrene or butadiene/styrene copolymers. The ratio of diene to styrene is preferably in the range from 2:1 to 1:2, particularly preferably about 55:45. The molecular weight Mw is in general from 10 000 to 300 000, preferably between 50 00 and 150 000. According to a particular aspect of the present invention, the proportion of double bonds after the hydrogenation is not more than 15%, particularly preferably not more than 5%, based on the number of double bonds before the hydrogenation.

Hydrogenated styrene/diene copolymers can be commercially obtained under the trade name ®SHELLVIS 50, 150, 200, 250 or 260.

In general, the amount of components A) is at least 20% by weight, preferably at least 30% by weight and particularly preferably at least 40% by weight, without there being any intention to impose a restriction hereby.

The Component B)

The component B) is formed from at least one dispersing component, it being possible for this component frequently to be regarded as block copolymers. Preferably, at least one of these blocks has high compatibility with the previously described polyolefins of components A), at least one further block of the blocks contained in the dispersing components having. only low compatibility with the previously described polyolefins. Such dispersing components are known per se, preferred compounds being described in the abovementioned prior art.

The radical compatible with components A) generally has a nonpolar character whereas the incompatible radical is of a polar nature. According to a particular aspect of the present invention, preferred dispersing components may be considered as block copolymers which comprise one or more blocks A and one or more blocks X, the block A representing olefin copolymer sequences, hydrogenated polyisoprene sequences, hydrogenated copolymers of butadiene/isoprene or hydrogenated copolymers of butadiene/isoprene and styrene and the block X representing polyacrylate-, polymethacrylate-, styrene-, α-methylstyrene or N-vinyl-heterocyclic sequences or sequences comprising mixtures of polyacrylate-, polymethacrylate-, styrene-, α-methylstyrene or N-vinyl-heterocycles.

Preferred dispersing components can be prepared by graft polymerization, polar monomers being grafted onto the polyolefins described above, in particular onto the OCP and HSD. For this purpose, the polyolefins can be pretreated by mechanical and/or thermal degradation.

The polar monomers include in particular (meth)acrylates and styrene compounds.

The expression (meth)acrylates includes methacrylates and acrylates and mixtures of the two.

According to a particular aspect of the present invention, a monomer composition comprising one or more (meth) acrylates of the formula (I)

(I)

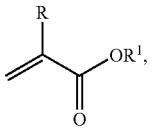

in which R denotes hydrogen or methyl and $R^1$ denotes hydrogen or a linear or branched alkyl radical having 1 to 40 carbon atoms, is used in the grafting reaction.

The preferred monomers according to formula (I) include, inter alia, (meth)acrylates which are derived from saturated alcohols, such as methyl (meth)acrylate, ethyl (meth)acrylate, n-propyl (meth)acrylate, isopropyl (meth)acrylate, n-butyl (meth)acrylate, tert-butyl (meth)acrylate, pentyl (meth)acrylate, hexyl (meth)acrylate, 2-ethylhexyl (meth) acrylate, heptyl (meth)acrylate, 2-tert-butylheptyl (meth) acrylate, octyl (meth)acrylate, 3-isopropylheptyl (meth) acrylate, nonyl (meth)acrylate, decyl (meth)acrylate, undecyl (meth)acrylate, 5-methylundecyl (meth)acrylate, dodecyl (meth)acrylate, 2-methyldodecyl (meth)acrylate, tridecyl (meth)acrylate, 5-methyltridecyl (meth)acrylate, tetradecyl (meth)acrylate, pentadecyl (meth)acrylate, hexadecyl (meth)acrylate, 2-methylhexadecyl (meth)acrylate, heptadecyl (meth)acrylate, 5-isopropylheptadecyl (meth) acrylate, 4-tert-butyloctadecyl (meth)acrylate, 5-ethyloctadecyl (meth)acrylate, 3-isopropyloctadecyl (meth)acrylate, octadecyl (meth)acrylate, nonadecyl (meth)acrylate, eicosyl (meth)acrylate, cetyleicosyl (meth)acrylate, stearyleicosyl (meth)acrylate, docosyl (meth)acrylate and/or eicosyltetratriacontyl (meth)acrylate; (meth)acrylates which are derived from unsaturated alcohols, such as, for example, 2-propynyl (meth)acrylate, allyl (meth)acrylate, vinyl (meth)acrylate, oleyl (meth)acrylate; cycloalkyl (meth)acrylates, such as cyclopentyl (meth)acrylate, 3-vinylcyclohexyl (meth)acrylate, cyclohexyl (meth)acrylate, bornyl (meth)acrylate.

Furthermore, the monomer composition may comprise one or more (meth)acrylates of the formula (II)

(II)

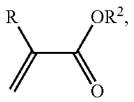

in which R denotes hydrogen or methyl and $R^2$ denotes an alkyl radical substituted by an OH group and having 2 to 20 carbon atoms or denotes an alkoxylated radical of the formula (III)

(III)

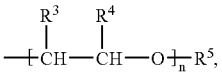

in which $R^3$ and $R^4$ independently represent hydrogen or methyl, $R^5$ represents hydrogen or an alkyl radical having 1 to 40 carbon atoms and n represents an integer from 1 to 90.

(Meth)acrylates according to formula (III) are known to a person skilled in the art. These include, inter alia, hydroxyalkyl (meth)acrylates, such as 3-hydroxypropyl methacrylate,
3,4-dihydroxybutyl methacrylate,
2-hydroxyethyl methacrylate,
2-hydroxypropyl methacrylate, 2,5-dimethyl-1,6-hexanediol (meth)acrylate,
1,10-decanediol (meth)acrylate,
1,2-propanediol (meth)acrylate;
polyoxyethylene and polyoxypropylene derivatives of (meth)acrylic acid, such as
triethylene glycol (meth)acrylate,
tetraethylene glycol (meth)acrylate and
tetrapropylene glycol (meth)acrylate.

The (meth)acrylates having a long-chain alcohol radical can be obtained, for example, by reacting the corresponding acids and/or short-chain (meth)acrylates, in particular methyl (meth)acrylate or ethyl (meth)acrylate, with long-chain fatty alcohols, in general a mixture of esters, such as, for example, (meth)acrylates having different long-chain alcohol radicals, being formed. These fatty alcohols include, inter alia, Oxo Alcohol® 7911 and Oxo Alcohol® 7900, Oxo Alcohol® 1100 from Monsanto; Alphanol® 79 from ICI; Nafol® 1620, Alfol® 610 and Alfole 810 from Condea; Epal® 610 and Epal® 810 from Ethyl Corporation; Linevol® 79, Linevol® 911 and Dobanol® 25L from Shell AG; Lial 125 from Augusta® Milan; Dehydad® and Lorol® from Henkel KGaA and Linopol® 7-11 and Acropol® 91 Ugine Kuhlmann.

Furthermore, the monomer composition may comprise and/or one or more (meth)acrylates of the formula (IV)

(IV)

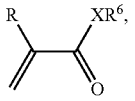

in which R denotes hydrogen or methyl, X denotes oxygen or an amino group of the formula —NH— or —$NR^7$—, in which $R^7$ represents an alkyl radical having 1 to 40 carbon atoms, and $R^6$ denotes a linear or branched alkyl radical substituted by at least one —$NR^8R^9$ group and having 2 to 20, preferably 2 to 6, carbon atoms, $R^8$ and $R^9$, independently of one another, representing hydrogen or an alkyl radical having 1 to 20, preferably 1 to 6 C-atoms, or in which $R^8$ and $R^9$, including the nitrogen atom and optionally a further nitrogen or oxygen atom, forming a 5- or 6-membered ring which optionally may be substituted by $C_1$-$C_6$-alkyl.

The (meth)acrylates or the (meth)acrylamides according to formula (IV) include, inter alia,
amides of (meth)acrylic acid, such as
N-(3-dimethylaminopropyl)methacrylamide,
N-(diethylphosphono)methacrylamide,
1-methacryloylamido-2-methyl-2-propanol,
N-(3-dibutylaminopropyl)methacrylamide,
N-tert-butyl-N-(diethylphosphono)methacrylamide,
N,N-bis(2-diethylaminoethyl)methacrylamide,
4-methacryloylamido-4-methyl-2-pentanol,
N-(methoxymethyl)methacrylamide,
N-(2-hydroxyethyl)methacrylamide,
N-acetylmethacrylamide,
N-(dimethylaminoethyl)methacrylamide,
N-methyl-N-phenylmethacrylamide,
N,N-diethylmethacrylamide,
N-methylmethacrylamide, N,N-dimethylmethacrylamide,
N-isopropylmethacrylamide;
aminoalkyl methacrylates, such as
tris(2-methyacryloyloxyethyl)amine,
N-methylformamidoethyl methacrylate,
2-ureidoethyl methacrylate;
heterocyclic (meth)acrylates, such as 2-(1-imidazolyl)-ethyl (meth)acrylate, 2-(4-morpholinyl)ethyl-(meth)acrylate and 1-(2-methacryloyloxyethyl)-2-pyrrolidone.

Furthermore, the monomer composition may comprise styrene compounds. These include, inter alia, styrene, substituted styrenes having an alkyl substituent in the side chain, such as, for example, α-methylstyrene and α-ethylstyrene, substituted styrenes having an alkyl substituent on the ring, such as vinyltoluene and p-methylstyrene, halogenated styrenes, such as, for example, monochlorostyrenes, dichlorostyrenes, tribromostyrenes and tetrabromostyrenes.

In addition, the monomer compositions may comprise heterocyclic vinyl compounds, such as 2-vinylpyridine, 3-vinylpyridine, 2-methyl-5-vinylpyridine, 3-ethyl-4-vinylpyridine, 2,3-dimethyl-5-vinylpyridine, vinylpyrimidine, vinylpiperidine, 9-vinylcarbazole, 3-vinylcarbazole, 4-vinylcarbazole, 1-vinylimidazole, 2-methyl-1-vinylimidazole, N-vinylpyrrolidone, 2-vinylpyrrolidone, N-vinylpyrrolidine, 3-vinylpyrrolidine, N-vinylcaprolactam, N-vinylbutyrolactam, vinyloxolane, vinylfuran, vinylthiophene, vinylthiolane, vinylthiazoles and hydrogenated vinylthiazoles, vinyloxazoles and hydrogenated vinyloxazoles.

In addition to styrene compounds and (meth)acrylates, particularly preferred monomers are monomers which have dispersing effects, such as, for example, the abovementioned heterocyclic vinyl compounds. These monomers are furthermore designated as dispersing monomers.

The abovementioned ethylenically unsaturated monomers may be used individually or as mixtures. It is furthermore possible to vary the monomer composition during the polymerization.

The weight ratio of the parts of the dispersing component which are compatible with the polyolefins, in particular of the blocks A, to the parts of the dispersing component which are incompatible with the polyolefins, in particular the blocks X, may be within wide ranges. In general, this ratio is in the range from 50:1 to 1:50, in particular from 20:1 to 1:20 and particularly preferably from 10:1 to 1:10.

The preparation of the dispersing components described above is known to those skilled in the art. For example, the preparation can be effected via a polymerization in solution. Such processes are described, inter alia, in DE-A 12 35 491, BE-A 592 880, U.S. Pat. No. 4,281,081, U.S. Pat. No. 4,338,418 and U.S. Pat. No. 4,290,025.

For this purpose, a mixture of the OCP and one or more of the monomers described above can be initially introduced into a suitable reaction vessel, expediently equipped with stirrer, thermometer, reflux condenser and metering line.

After dissolution under an inert atmosphere, such as, for example, nitrogen, with heating, for example to 110° C., a proportion of a customary free radical initiator, for example from the group consisting of the peresters, is prepared, initially, for example, about 0.7% by weight, based on the monomers.

Thereafter, a mixture of the remaining monomers is metered over a few hours, for example 3.5 hours, with addition of further initiator, for example about 1.3% by weight, based on the monomers. A little more initiator is expediently fed sometime after the end of the addition, for example after two hours. The total duration of the polymerization can be taken as a guide value, for example with about 8 hours. After the end of the polymerization, dilution is expediently effected with a suitable solvent, such as, for example, a phthalic ester, such as dibutyl phthalate. As a rule, a virtually clear, viscous solution is obtained.

Furthermore, the preparation of the polymer dispersion can be effected in a kneader, an extruder or a static mixer. As a result of the treatment in the apparatus, a decrease in the molecular weight of the polyolefin, in particular of the OCP or HSD, occurs under the influence of the shear forces, of the temperature and of the initiator concentration.

Examples of initiators suitable for the graft copolymerization are cumyl hydroperoxide, dicumyl peroxide, benzoyl peroxide, azobisisobutyronitrile, 2,2-bis(tert-butylperoxy) butane, diethyl peroxy-dicarbonate and tert-butyl peroxide. The processing temperature is between 80° C. and 350° C. The residence time in the kneader or extruder is between 1 minute and 10 hours.

The longer the dispersion is treated in the kneader or extruder, the lower will be the molecular weight. The temperature and the concentration of free radical initiators can be adjusted according to the desired molecular weight. By incorporation into suitable carrier media, the solvent-free polymer-in-polymer dispersion can be converted into a liquid polymer/polymer emulsion which is easy to handle.

The amount of components B) is in general up to 30% by weight, and in particular this amount is in the range from 5 to 15% by weight, without there being any intention to impose a restriction hereby. The use of larger amounts of component B) is frequently uneconomical. Smaller amounts often lead to lower stability of the polymer dispersion.

The Component C)

The component C) is essential for the success of the present invention. The esters to be used in the polymer dispersions are known to those skilled in the art.

These include in particular phosphoric esters, esters of dicarboxylic acids, esters of monocarboxylic acids with diols or polyalkylene glycols, esters of neopentylpolyols with monocarboxylic acids (cf. Ullmanns Encyclopadie der Technischen Chemie [Ullmann's Encyclopaedia of Industrial Chemistry], 3rd edition, Vol. 15, pages 287-292, Urban & Schwarzenberg (1964)).

Suitable esters of dicarboxylic acids are firstly the esters of phthalic acid, in particular the phthalic esters with $C_4$ to $C_8$-alcohols, dibutyl phthalate and dioctyl phthalate being mentioned in particular, and secondly the esters of aliphatic dicarboxylic acids, in particular the esters of straight-chain dicarboxylic acids with branched primary alcohols. The esters of sebacic, of adipic and of azelaic acid are singled out in particular, and in particular the 2-ethylhexyl and isooctyl-3,5,5-trimethyl esters and the esters with the $C_8$-, $C_9$- and $C_{10}$-oxo alcohols should be mentioned.

The esters of straight-chain primary alcohols with branched dicarboxylic acids are particularly important. Alkyl-substituted adipic acid, for example 2,2,4-trimethyladipic acid, may be mentioned as examples.

Preferred esters have (oligo)oxyalkyl groups in the alcohol radical. These include in particular ethylene glycol and propylene glycol groups.

The diesters with diethylene glycol, triethylene glycol, tetraethylene glycol to decamethylene glycol and furthermore with dipropylene glycol as alcohol component may be singled out as esters of monocarboxylic acids with diols or polyalkylene glycols. Propionic acid, (iso)butyric acid and pelargonic acid may be mentioned specifically as monocarboxylic acids—for example, dipropylene glycol pelargonate, diethylene glycol dipropionate and diisobutyrate and the corresponding esters of triethylene glycol, and tetraethylene glycol di-2-ethylhexanoate, being mentioned.

These esters are used individually or as a mixture.

According to a particular aspect of the present invention, the polymer dispersion contains preferably from 2 to 40% by weight, in particular from 5 to 30% by weight and particularly preferably from 10 to 20% by weight of at least one ester.

The Component D)

The component D) is obligatory for the present polymer dispersion, this component containing one or more ethers comprising at least one (oligo)oxyalkyl groups. In general, the compounds according to component D) comprise preferably from 1 to 40, in particular from 1 to 20 and particularly preferably from 2 to 8 oxyalkyl groups.

The oxyalkyl groups are in general of the formula (V)

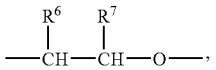

(V)

in which $R^6$ and $R^7$ independently represent hydrogen or an alkyl radical having 1 to 10 carbon atoms, the groups $R^6$ and $R^7$ preferably representing hydrogen.

The oxyalkyl groups include in particular the ethoxy, the propoxy and the butoxy groups, the ethoxy groups being preferred.

The hydrophobic radical of the ethoxylated alcohols comprises preferably from 1 to 40, preferably from 4 to 22, carbon atoms, it being possible to use both linear and branched alkyl radicals. Oxo alcohol ethoxylates may also be used.

The preferred hydrophobic radicals of these ethers include, inter alia, the methyl, ethyl, propyl, butyl, pentyl, 2-methylbutyl, pentenyl, cyclohexyl, heptyl, 2-methylheptenyl, 3-methylheptyl, octyl, nonyl, 3-ethylnonyl, decyl, undecyl, 4-propenylundecyl, dodecyl, tridecyl, tetradecyl, pentadecyl, hexadecyl, heptadecyl, octadecyl, nonadecyl, eicosyl, cetyleicosyl, docosyl and/or eicosyltetratriacontyl group.

Examples of commercial ethoxylates which can be used for the preparation of the concentrates according to the invention are ethers of Lutensol® A grades, in particular Lutensol® A 3 N, Lutensol® A 4 N, Lutensol® A 7 N and Lutensol®. A 8 N, ethers of Lutensol® TO grades, in particular Lutensol® TO 2, Lutensol® TO 3, Lutensol® TO 5, Lutensol® TO 6, Lutensol® TO 65, Lutensol® TO 69, Lutensol® TO 7, Lutensol® TO 79, Lutensol® 8 and Lutensol® 89, ethers of Lutensol® AO grades, in particular Lutensol® AO 3, Lutensol® AO 4, Lutensol® AO 5, Lutensol® AO 6, Lutensol® AO 7, Lutensol® AO 79, Lutensol® AO 8 and Lutensol® AO 89, ethers of Lutensol® ON grades, in particular Lutensol® ON 30, Lutensol® ON 50, Lutensol® ON 60, Lutensol® ON 65, Lutensol® ON 66, Lutensol® ON 70, Lutensol® ON 79 and Lutensol® ON 80, ethers of Lutensol® XL grades, in particular Lutensol® XL 300, Lutensol® XL 400, Lutensol® XL 500, Lutensol® XL 600, Lutensol® XL 700, Lutensol® XL 800, Lutensol® XL 900 and Lutensol® XL 1000, ethers of Lutensol® AP grades, in particular Lutensol® AP 6, Lutensol® AP 7, Lutensol® AP 8, Lutensol® AP 9, Lutensol® AP 10, Lutensol® AP 14 and Lutensol® AP 20, ethers of IMBENTIN® grades, in particular of IMBENTIN® AG grades, of IMBENTIN® U grades, of IMBENTIN® C grades, of IMBENTIN® T grades, of IMBENTIN® OA grades, of IMBENTIN® POA grades, of IMBENTIN® N grades and of IMBENTIN®O grades and ethers of Marlipal® grades, in particular Marlipal® 1/7, Marlipal® 1012/6, Marlipal® 1618/1, Marlipal® 24/20, Marlipal® 24/30, Marlipal® 24/40, Marlipal® 013/20, Marlipal® 013/30, Marlipal® 013/40, Marlipal® 025/30, Marlipal® 025/70, Marlipal® 045/30, Marlipal® 045/40, Marlipal® 045/50, Marlipal® 045/70 and Marlipal® 045/80.

These ethers may be used individually or as a mixture.

According to a particular aspect of the present invention, the polymer dispersion contains preferably from 2 to 40% by weight, in particular from 5 to 30% by weight and particularly preferably from 10 to 20% by weight of ethers which comprise (oligo)oxyalkyl groups.

The weight ratio of ester to ether having (oligo)oxyalkyl groups is in the range from 30:1 to 1:30, preferably in the range from 15:1 to 1:15, in particular in the range from 5:1 to 1:5.

The amount of the components C) and D), based on the concentrated polymer dispersion, may be within wide ranges, this amount being dependent in particular on the polyolefins and dispersing components used. In general, the amount of the components C) and D) together is from 79 to 25% by weight, preferably less than 70, especially from 60 to 40, % by weight, based on the total polymer dispersion.

In addition to the abovementioned components, the polymer dispersion according to the invention may contain further additives and admixed substances.

In particular, further carrier media can therefore be used in the polymer dispersion. These include in particular mineral oils, it surprisingly having been found that the stability of the polymer dispersions can be increased by adding mineral oils.

Mineral oils are known per se and are commercially available. They are obtained in general from petroleum or crude oil by distillation and/or refining and optionally further purification and treatment processes, the term mineral oil covering in particular the relatively high-boiling fractions of crude oil or petroleum. In general, the boiling point of mineral oil is higher than 200° C., preferably higher than 300° C., at 5 000 Pa. The production by low-temperature carbonization of shale oil, coking of hard coal, distillation of lignite in the absence of air and hydrogenation of hard coal or lignite is likewise possible. To a small extent, mineral oils are also produced from raw materials of vegetable (e.g. from jojoba, rape) or animal (e.g. neatsfoot oil) origin. Accordingly, mineral oils have different fractions of aromatic, cyclic, branched and linear hydrocarbons, depending on origin.

In general, a distinction is made between paraffin-based, naphthenic and aromatic fractions in crude oils or mineral oils, the terms paraffin-based fraction representing relatively long-chain and highly branched isoalkanes and naphthenic fraction representing cycloalkanes. In addition, depending on origin and treatment, mineral oils have different proportions of n-alkanes, isoalkanes having a low degree of branching, so-called monomethyl-branched paraffins, and compounds having heteroatoms, in particular O, N and/or S, to which to a certain extent polar properties are attributed. However, the assignment is difficult since individual alkane molecules may have both long-chain branched groups and cycloalkane radicals and aromatic moieties. For the purposes of the present invention, the assignment can be made, for example, according to DIN 51 378. Polar moieties can also be determined according to ASTM D 2007.

The proportion of the n-alkanes in preferred mineral oils is less than 3% by weight, in the proportion of 0, N and/or S-containing compounds less than 6% by weight. The proportion of aromatics and of monomethyl-branched paraffins is in general in each case in the range from 0 to 40% by weight. According to an interesting aspect, mineral oil mainly comprises naphthenic and paraffin-based alkanes, which in general have more than 13, preferably more than 18 and very particularly preferably more than 20, carbon atoms. The proportion of these compounds is in general ≧60% by weight, preferably ≧80% by weight, without it being intended to impose any restriction hereby. A preferred mineral oil contains from 0.5 to 30% by weight of aromatic fractions, from 15 to 40% by weight of naphthenic fractions, from 35 to 80% by weight of paraffin-based fractions, up to 3% by weight of n-alkanes and from 0.05 to 5% by weight of polar. compounds, based in each case on the total weight of the mineral oil.

An analysis of particularly preferred mineral oils which was effected by means of conventional methods, such as urea separation and liquid chromatography over silica gel, indicates, for example, the following components, the stated percentages being based on the total weight of the mineral oil used in each case:

n-alkanes having about 18 to 31 C atoms:
0.7-1.0%,
alkanes having 18 to 31 C atoms and a low degree of branching:
1.0-8.0%,
aromatics having 14 to 32 C atoms:
0.4-10.7%,
iso- and cycloalkanes having 20 to 32 C atoms:
60.7-82.4%,
polar compounds:
0.1-0.8%,
loss:
6.9-19.4%.

Valuable information regarding the analysis of mineral oils and a list of mineral oils which have a differing composition is to be found, for example, in Ullmanns Encyclopedia of Industrial Chemistry, $5^{th}$ edition on CD-ROM, 1997, key word "lubricants and related products".

The polymer dispersion may comprise up to 50% by weight, preferably up to 30% by weight, of mineral oil.

Preferred additives are further nonionic surfactants. These include, inter alia, fatty acid polyglycol esters, fatty amine polyglycol ethers, alkylpolyglycosides, fatty amine N oxides and long-chain alkyl sulphoxides.

Furthermore, the polymer dispersion of the present invention may comprise compounds having a dielectric constant greater than or equal to 9, in particular greater than or equal to 20 and particularly preferably greater than or equal to 30. Surprisingly, it was found that the viscosity of the polymer dispersion can be reduced by adding these compounds. It is possible thereby in particular to adjust the viscosity to a predetermined value.

The dielectric constant can be determined by methods stated in Handbook of Chemistry and Physics, David R. Lide, 79th Edition, CRS Press, the dielectric constant being measured at 20° C.

The particularly suitable compounds include, inter alia, water, glycols, in particular ethylene glycol, 1,2-propylene glycol, 1,3-propylene glycol, polyethylene glycol; alcohols, in particular methanol, ethanol, butanol, glycerol; ethoxylated alcohols, for example diethoxylated butanol, decaethoxylated methanol; amines, in particular ethanolamine, 1,2-ethanediamine and propanolamine; halogenated hydrocarbons, in particular 2-chloroethanol, 1,2-dichloroethane, 1,1-dichloroacetone; ketones, in particular acetone.

The proportion of the compounds described above in the polymer dispersion may be within wide ranges. In general, the polymer dispersion comprises up to 15% by weight, in particular from 0.3 to 5% by weight, of compounds having a dielectric constant greater than or equal to 9.

The polymer dispersions can be prepared by known processes, these processes being described in the abovementioned documents of the prior art. Thus, for example, the present polymer dispersions can be prepared by dispersing component A) in a solution of components B) with application of shear forces at a temperature in the range of from 80 to 180° C. The solution of components B) comprises in general components C) and D). These components can be added to the dispersion before, during or after the dispersing of components A).

The invention is explained in more detail below by examples and comparative examples, without it being intended to restrict the invention to these examples.

Methods Used

Below, KV100 means the kinematic viscosity of a liquid, measured at 100° C. in a 150 N oil. The determination of the viscosity is carried out according to DIN 51 562 (Ubbelohde viscometer). Here, the concentration of the OCP in oil is in each case 2.8% by weight. The data BV20, BV40 and BV100 designate the kinematic viscosities of the dispersions (BV="bulk viscosity"), likewise measured according to DIN 51 562 (Ubbelohde viscometer) at 20, 40 and 100° C., respectively.

Initiators used for the preparation of the dispersions were conventional members, such as, for example, the per initiators di(tert-butylperoxy)-3,3,5-trimethyl-cyclohexane and/or tert-butyl peroctanoate.

For testing the stability of a dispersion, 670 g of the product can be weighed into a 2 liter Witt pot. An Inter-Mig stirrer having three paddles (measuring stirrer with torque and speed indication MR-D1 from Ika) and an NiCrNi thermocouple (temperature controller 810 from Eurotherm) are installed in the Witt pot. The oil bath (silicone oil PN 200) is heated up, the speed being adjusted so that a power of 3.1 watt is introduced. The power introduced can be calculated via the viscosity.

The product is heated to 160° C. and this internal temperature is then maintained for 2 h. Thereafter, the internal temperature in the reactor is increased by 10° C. in the course of 15 minutes and once again maintained for 2 h, this procedure being repeated several times until the internal temperature is 190° C. If the product undergoes phase separation beforehand, which is evident from an abrupt increase in the viscosity and hence from a rapid increase in the torque, the experiment is terminated. The time and temperature at this point in time are detected.

EXAMPLE 1

In a 2 liter four-necked flask equipped with stirrer, thermometer and reflux condenser, 63.8 g of a styrene/diene copolymer (e.g. SHELLVIS® 260) are dissolved in 271.3 g of an ester (e.g. Vestinol® OA) and 90.4 g of an ethoxylated fatty alcohol (e.g. Marlipal® 013/20) at 100° C. in the course of 3-4 hours. After the dissolution process, 47.3 g of a C12-C16-alkyl methacrylate are added and inert conditions are created by adding dry ice. The temperature is again adjusted to 100° C., after which 1.14 g of tert-butyl peroctanoate are added and at the same time a feed consisting of a mixture of 527.2 g of the C12-C16 alkyl methacrylate and 6.33 g of tert-butyl peroctanoate is started. The feed time is 3.5 hours. The feed rate is constant. 2 hours after the end of the feed, a further 1.15 g of tert-butyl peroctanoate are added. 134.2 g of the prepared solution together with 196.8 g of the styrene/diene copolymer (e.g. SHELLVIS® 260) and 169.0 g of the ethoxylated fatty alcohol (e.g. Marlipal® O13/20) are weighed into a 1 liter Witt pot having an Inter-Mig stirrer (ratio of stirrer/container diameter=0.7; stirrer speed to be set: 200 rpm). A dispersion forms in the course of 8-10 hours at 100° C. and a stirrer speed of 200 rpm. The division of the 196.8 g of the styrene/diene copolymer into 24 portions of 8.2 grams each and the sequential addition of these portions with stirring (200 rpm) at a time interval of 5 minutes leads to the same result. The actual viscosity of this highly concentrated Shellvis 260 dispersion is about 4 000 $mm^2/s$ at 40° C. and about 5 000 $mm^2/s$ at 100° C.

COMPARATIVE EXAMPLE 1

In a 2 liter four-necked flask equipped with a stirrer, thermometer and reflux condenser, 63.8 g of a styrene/diene copolymer (e.g. SHELLVIS® 260 from Infineum) are dissolved in 361.7 g of an ester (e.g. Vestinol® OA) at 100° C. in the course of 3-4 hours. After the dissolution process, 47.3 g of a C12-C16-alkyl methacrylate are added and inert conditions are created by adding dry ice. The temperature is adjusted again to 100° C., after which 1.14 g of tert-butyl peroctanoate are added and at the same time a feed consisting of a mixture of 527.2 g of the C12-C16 alkyl methacrylate and 6.33 g of tert-butyl peroctanoate is started. The feed time is 3.5 hours. The feed rate is constant. 2 hours after the end of the feed, a further 1.15 g of tert-butyl peroctanoate are added.

167.5 g of the graft copolymer described above are weighed, together with 168.1 g of the styrene/diene copolymer (e.g. SHELLVIS 260) and 164.4 g of the ester (e.g. Vestinol® OA), into a 1 liter Witt pot having an Inter-Mig stirrer (ratio of stirrer/container diameter=0.7; stirrer speed 200 rpm) and stirred at 100° C. with a stirrer speed of 200 rpm. In the course of 8-10 hours, a phase having a high content of the styrene/diene copolymer separates out. It is not possible to prepare a stable dispersion.

The invention claimed is:

1. A stable polymer dispersion comprising

A) at least one dispersed polyolefin,

B) at least one dispersing component,

C) at least one ester and

D) at least one ether comprising (oligo)oxyalkyl groups, wherein component D) comprises at least one ethoxylated alcohol, wherein the ethoxylated alcohol comprises from 2 to 8 ethoxy groups and the hydrophobic radical of the alcohol comprises from 1 to 40 carbon atoms.

2. The stable polymer dispersion according to claim 1, wherein component B) represents, a copolymer which comprises one or more blocks A and one or more blocks X, the block A representing olefin copolymer sequences, hydrogenated polyisoprene sequences, hydrogenated copolymers of butadiene/isoprene or hydrogenated copolymers of butadiene/isoprene and styrene, and the block X representing polyacrylate-, polymethacrylate-, styrene-, α-methylstyrene or N-vi nyl-heterocyclic sequences and/or sequences of mixtures of polyacrylate-, polymethacrylate-, styrene-, α-methylstyrene or N-vinyl-heterocycles.

3. The stable polymer dispersion according to claim 1, wherein component B) is obtainable by graft copolymerization of a monomer composition comprising (meth)acrylates and/or styrene compounds onto a polyolefin.

4. The stable polymer dispersion according to claim 3, wherein the monomer composition comprises one or more (meth)acrylates of the formula (I)

(II)

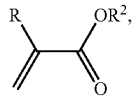

in which

R denotes hydrogen or methyl and $R^1$ denotes hydrogen or a linear or branched alkyl radical having 1 to 40 carbon atoms, and/or one or more (meth)acrylates of the formula (II)

(III)

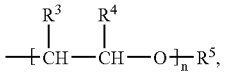

in which

R denotes hydrogen or methyl and $R^2$ denotes an alkyl radical substituted by an OH group having 2 to 20 carbon atoms or denotes an alkoxylated radical of the formula (III)

(IV)

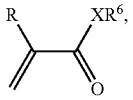

in which $R^3$ and $R^4$ independently represent hydrogen or methyl, $R^5$ represents hydrogen or an alkyl radical having 1 to 40 carbon atoms and n represents an integer from 1 to 90, and/or one or more (meth)acrylates of the formula (IV)

(I)

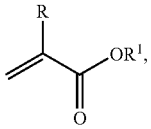

in which

R denotes hydrogen or methyl,

X denotes oxygen or an amino group of the formula NH or $NR^7$, in which $R^7$ represents an alkyl radical having 1 to 40 carbon atoms, and $R^6$ denotes a linear or branched alkyl radical substituted by at least one $NR^8R^9$ group and having 2 to 20 carbon atoms, $R^8$ and $R^9$, independently of one another, representing hydrogen, an alkyl radical having from 1 to 20 carbon atoms or in which $R^8$ and $R^9$, including the nitrogen atom and optionally a further nitrogen or oxygen atom, form a 5- or 6-membered ring which may optionally be substituted by $C^1$-C6-alkyl.

5. The stable polymer dispersion according to claim 3, wherein a monomer composition which comprises dispersing monomers is used in the grafting reaction.

6. The stable polymer dispersion according to claim 2, wherein the weight ratio of the blocks A to the blocks X is in the range from 20:1 to 1:20.

7. The stable polymer dispersion according to claim 1, wherein the component A) comprises one or more olefin copolymers, hydrogenated polyisoprene, hydrogenated copolymers of butadiene/isoprene or hydrogenated copolymers of butadiene/isoprene and styrene.

8. The stable polymer dispersion according to claim 1, wherein the hydrophobic radical of the alcohol comprising from 4 to 22 carbon atoms.

9. The stable polymer dispersion according to claim 1, wherein the stable polymer dispersion comprises from 2 to 40% by weight of component C).

10. The stable polymer dispersion according to claim 1, wherein the weight ratio of component C) to component D) is in the range from 15:1 to 1:15.

11. The stable polymer dispersion according to claim 1, wherein the stable polymer dispersion comprises at least 20% by weight of the component A).

12. The stable polymer dispersion according to claim 1, wherein the polymer dispersion comprises from 2 to 40% by weight of the components D).

13. The stable polymer dispersion according to claim 1, wherein the stable polymer dispersion further comprises a compound which has a dielectric constant greater than or equal to 9.

14. The stable polymer dispersion according to claim 13, wherein the compound having a dielectric constant greater than or equal to 9 is selected from the group consisting of water, ethylene glycol, polyethylene glycol, alcohol and mixtures thereof.

15. The stable polymer dispersion according to claim 1, wherein the stable polymer dispersion comprises up to 30% by weight of component B).

16. A process for the preparation of the stable polymer dispersion according to a claim 1, comprising dispersing component A) in a solution of components B) with application of shear forces at a temperature in the range from 80 to 180° C.

17. An additive for lubricating oil comprising the stable polymer dispersion as claimed in claim 1.

18. A method for producing a lubricating oil comprising adding the stable polymer dispersion as claimed in claim 1, to a lubricating oil formulation.

19. A lubricating oil comprising the stable polymer dispersion as claimed in claim 1.

20. The stable polymer dispersion according to claim 4, wherein $R^8$ and $R^9$, independently of one another, represent an alkyl radical having from 1 to 6 carbon atoms.

21. The stable polymer dispersion according to claim 4, wherein $R^6$ denotes a linear or branched alkyl radical substituted by at least one $NR^8R^9$ group and having 2 to 6 carbon atoms.

* * * * *